US005937466A

United States Patent [19]

Brainerd et al.

[11] Patent Number: 5,937,466

[45] Date of Patent: Aug. 17, 1999

[54] LUGGED ICE AXE HEAD

[75] Inventors: Charles Brainerd; Kenneth Stone, both of Salt Lake City, Utah

[73] Assignee: Black Diamond Equipment, Ltd, Salt Lake City, Utah

[21] Appl. No.: 08/589,115

[22] Filed: Jan. 19, 1996

[51] Int. Cl.[6] ..... B25D 1/00

[52] U.S. Cl. ..... 7/145; 7/162; 30/308.1; 30/308.3

[58] Field of Search ..... 30/308.1–308.3, 30/342, 344; 7/144, 145, 167, 168; 81/489, 492; 16/110 R

[56] References Cited

U.S. PATENT DOCUMENTS

| | | | |
|---|---|---|---|
| 802,937 | 10/1905 | McCune et al. | 30/308.3 X |
| 1,177,472 | 3/1916 | Bartlett | 30/308.3 X |
| 1,259,161 | 3/1918 | Suer | 30/308.1 |
| 1,309,180 | 7/1919 | Carr | 7/145 X |
| 1,388,872 | 8/1921 | McElhaney | 30/308.1 X |
| 2,738,815 | 3/1956 | Hoeldtke | 30/308.1 |
| 2,804,109 | 8/1957 | Fatica | 30/308.1 |
| 3,114,973 | 12/1963 | Kennedy | 30/342 |

FOREIGN PATENT DOCUMENTS

| | | | |
|---|---|---|---|
| 5494 | 3/1907 | United Kingdom | 30/308.3 |

*Primary Examiner*—Douglas D. Watts
*Attorney, Agent, or Firm*—Thorpe, North & Western, L.L.P.

[57] ABSTRACT

A lugged ice axe head including a head portion which may have accessories, such as an ice pick, attached thereto; and a lug sleeve attached to and extending generally downwardly from the ice axe head. The lug sleeve has a hollow central portion with an open lower end which is formed to receive a top end of a handle so that the handle securely nests within the central hollow. The handle is anchored within the elongate sleeve such that the sleeve inhibits damaging of the handle by misplaced blows.

23 Claims, 3 Drawing Sheets

LUGGED ICE AXE HEAD

BACKGROUND OF THE INVENTION

1. Field of the Invention

The present invention relates to an ice axe head and, in particular, to a lugged ice axe head which protects the handle adjacent the ice axe head from damage due to misdirected blows contacting the handle.

2. State of the Art

The popularity of mountain climbing in areas which involve ice formations has increased significantly in recent years. To assist the climber in overcoming these obstacles, numerous ice axes have been developed. Typically an ice axe will include a metallic head which holds a hammer or adze and an ice pick. A handle made of tubular aluminum or other materials extends downwardly from the metallic head for gripping by the user.

The climber uses the axe to climb by using the respective parts to dig into the ice or nearby rocks. For example, the hammer is used to drive anchors into the ice or rocks, and, if properly formed, can be wedged into cracks and crevices in the ice formation to help support and stabilize the climber.

An adze, while not designed to drive in support spikes, is particularly useful for exploiting the cracks and crevices in the ice. The adze has a delta shape with notches formed along the outside edge to facilitate catching on the ice as it is pried into cracks and crevices. The adze is also particularly useful for cutting foot holds and hand holds in the ice.

The ice pick is used by driving the pick into the ice sufficiently deep that the climber can use the handle to pull himself or herself up the ice formation. To accomplish this, considerable force must be used when swinging the ice axe to penetrate the ice sufficiently.

One major problem with ice axes is that they are often damaged during a climb. If the climber's swing is slightly misdirected, the handle of the ice axe may strike a rock or other hard surface. The impact usually occurs adjacent the ice axe head, where the handle is traveling at its greatest speed and where impact force is the greatest. No support to the outside of the handle is provided by the axe head, as ice axe heads tend to be attached to the inside of the handle. After repeated blows, the unprotected handle can begin to weaken, thereby necessitating the replacement of the ice axe.

In attempts to alleviate such concerns, some have suggested placement of a ferrule around the handle shaft to minimize damage of misdirected blows. The ferrules, however, require assembly and add an extra part, thereby increasing the weight and cost of the ice axe. To most climbers, weight is a critical factor as they must swing the ice axe hundreds, if not thousands, of times on a typical climb. Additionally, the ferrule requires additional assembly.

Thus, there is a need for an ice axe which has a protected handle portion to thereby minimize damage to the handle caused by misdirected blows. Such an ice axe should also avoid unnecessary weight and should be easy to manufacture.

SUMMARY OF THE INVENTION

It is an object of the present invention to provide an ice axe which has a handle portion which is protected from misdirected blows.

It is another object of the present invention to provide such an ice axe in which an attachment between the ice axe head and the handle also provides a shield for protecting the handle, thereby keeping weight to a minimum while accomplishing both functions and keeping assembly concerns to a minimum.

It is yet another object of the present invention is to provide such an attachment which can be used with numerous different types of ice axe heads.

The above and other objects of the invention are realized in specific illustrative embodiments of a lugged ice axe head including a head portion which may have accessories, such as an ice pick, attached thereto; a hammer head or an adze; and a lug sleeve attached to and extending generally downwardly from the ice axe head. The lug sleeve has a hollow central portion with an open lower end which is formed to receive a top end of a handle so that the handle securely nests within the central hollow.

In accordance with one aspect of the invention, the lug sleeve may be adhesively bonded or mechanically attached to the handle, thereby securely attaching the ice axe head to the handle.

In accordance with another aspect of the present invention, the lug sleeve is formed of a durable material, such as a steel alloy or aluminum, and has a sufficient thickness to withstand repeated blows without allowing the portion of the handle contained within the central hollow to be damaged.

In accordance with yet another aspect of the present invention, the lug sleeve has a plurality of openings strategically placed in the lug sleeve to minimize weight while providing adequate protection to the upper end of the handle.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
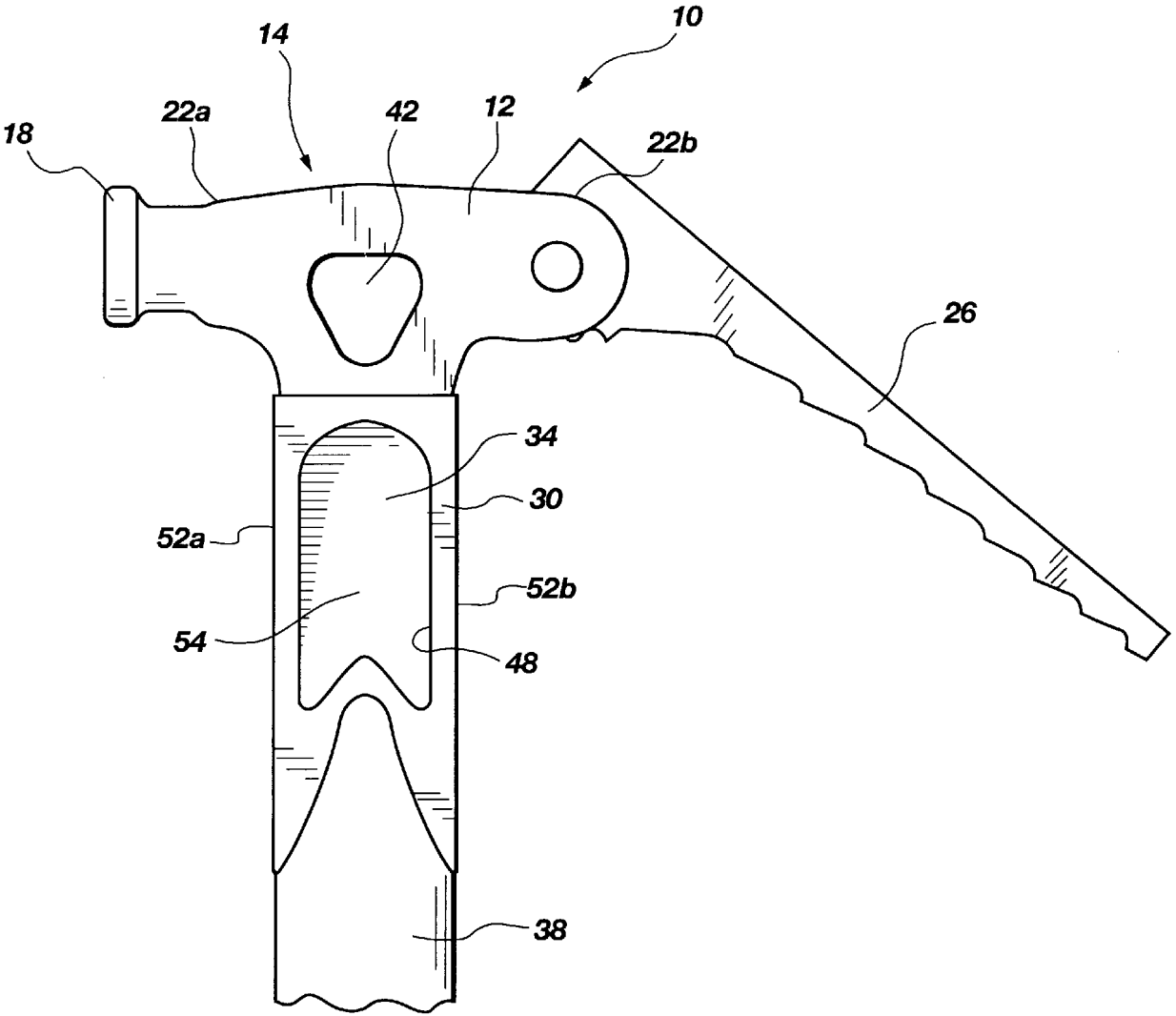
FIG. 1 shows a side view of a lugged ice axe head made in accordance with the teachings of the present invention, the ice axe head having a hammer head formed integrally therewith, and an ice pick and handle attached thereto.

Referring to FIG. 1, there is shown a side view of a lugged ice axe, generally indicated at 10, made in accordance with the present invention. The ice axe 10 includes a head 12 having a head portion, generally indicated at 14, which has a hammer 18 extending from a first end 22*a* and an ice pick 26 attached to an opposing second end 22*b*. The ice axe head 12 allows the ice pick to be added or removed from the head as desired by the user. Those skilled in the art will appreciate that this is a typical arrangement for an ice axe head, and that other ice axes are available in which the hammer head is not formed integrally with the ice axe head so that the hammer head may be replaced with another hammer head or with an adze.

Attached to the ice axe head 12 and extending downwardly from the head portion 14 is an elongate lug sleeve 30. By attached is meant that the ice axe head portion 14 and the lug sleeve 30 may be formed as an integral unit, or may be connected by welding or some other durable attachment method.

The lug sleeve 30 is disposed about an upper end 34 of a conventional ice axe handle 34. The lug sleeve 30 has an inner diameter (discussed in additional detail with respect to FIG. 4) which is slightly larger than the outer diameter of the handle 38 at the upper portion 34 to enable the upper portion to nest within a central hollow of the lug sleeve 30.

As shown in FIG. 1, the head portion 14 of the ice axe 10 has a void 42 formed therein. The void 42 decreases the overall weight of the ice axe 10 and decreases the energy expended during use. The void 42 also forms a convenient place to attach a wrist leash or a carabiner. Because of this, such voids have become common in currently available ice axe heads.

An opening 48 is also formed in the lug sleeve 30 to further minimize weight. When a conventional ice axe 10 is used, a misdirected swing can result in the upper portion 34 of the handle 38 impacting against a rock or other hard object and damaging the handle. The areas which are most prone to such damage are the forward and rearward sides 52*a* and 52*b*, respectively. In other words, as the ice axe is swung, it is the leading side or curvature of the upper portion 34 (and the area immediately adjacent to it) which is most prone to damage. Depending on which accessory is being used, the leading side will be the forward side 52*a* or the rearward side 52*b*. Thus, the lug sleeve 30 will typically be longest along one or both of these sides.

The lateral sides 54 of the upper portion are less prone to damage because most blows to these areas will be glancing blows or ricochets. Therefore, it is best that any openings 48 designed in the lug sleeve 30 be positioned on the portion of the sleeves that will be generally perpendicular to the axis of motion when the ice axe is in use.

The lug sleeve 30 may be attached to the handle 38 in numerous ways. For example, both metallic and composite handles may be adhesively attached to the lug sleeve 30. In the alternative, other methods of attachment, such as rivets or bolts which pass through the handle 38 and the sleeve 30, may be used. Still other methods of attachment might include welding the sleeve 30 and the handle 38 together if both are metallic. Of course, additional security could be provided by using two or more methods at the same time. Thus, for example, the handle 38 could be rivetted and adhesively attached to the handle, or could be welded and bolted.

Those familiar with ice axes will appreciate that a majority of the sleeve 30 can be covered with a rubber-like coating which is typically bonded to the handle 38. The rubber coating makes the handle 38 more comfortable to use, especially under freezing conditions which typically accompany ice climbing. The rubber could also be attached so as to fill the voids created by the openings 48.

Figure 2:
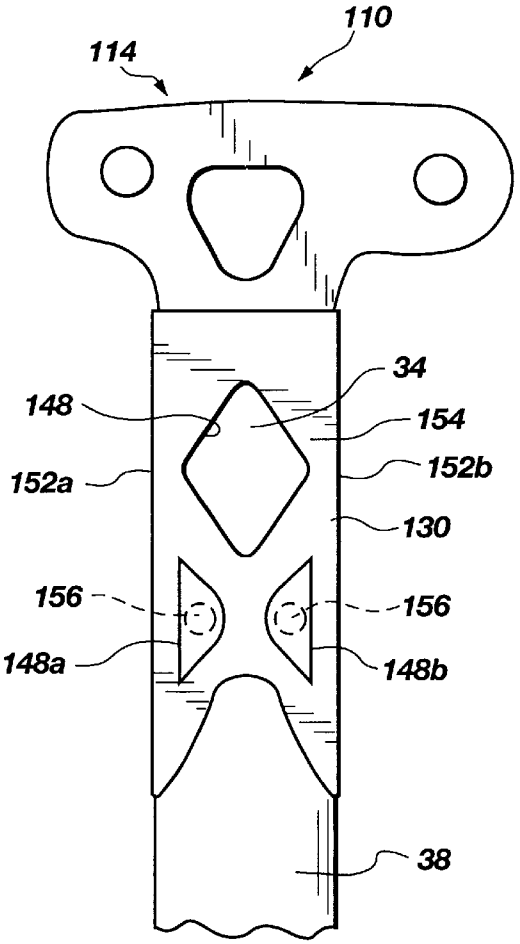
FIG. 2 shows a side view of another lugged ice axe head made in accordance with the teachings of the present invention; with a handle attached to the ice axe head.

Referring now to FIG. 2, there is shown a side view of a lugged modular ice axe 110 with the accessories removed. The ice axe 110 has a head portion 114 which is unattached to any accessories. Those familiar with ice climbing will appreciate that modular ice axe heads are now extremely popular, as they allow a climber to select the desired accessories before each climb and allow replacement of damaged parts.

The ice axe head portion 114 is attached to the upper end 34 of the handle 38 by a lug sleeve 130 which is formed integrally with the head portion. The lug sleeve 130 is similar to the lug sleeve 30 in FIG. 2 in that it extends further on the forward and rearward sides 152*a* and 152*b*, respectively, than on the lateral sides 154. The sleeve 130 is different in that it has three smaller openings 142 on the lateral sides 154, in place of the one large opening 48 in FIG. 1.

The smaller openings 142 lessen the risk that a glancing or ricochet blow to the side of the upper portion 34 of the handle 38 will damage the handle. Unless the item contacted is relatively pointed, the object which is struck will contact primarily the sleeve instead of the handle 38. However, such an arrangement also increases the weight of the sleeve 130 and manufacturing difficulty. Thus, the user can select a sleeve by contrasting the benefits of the respective embodiments. If the climber will be encountering ice formations in which projecting rocks will be frequently encountered, the embodiment of FIG. 2 may be chosen, while a climber who will not be encountering sharp rocks may opt for the slightly lighter version.

One advantage of the plurality of smaller holes is that the holes can be conveniently used by bolts 156 or rivets passing through the handle 38 to secure the sleeve 130 to the handle. Of course, holes could be drilled through the sleeve 130, or formed therein when the sleeve is made.

Figure 3A:
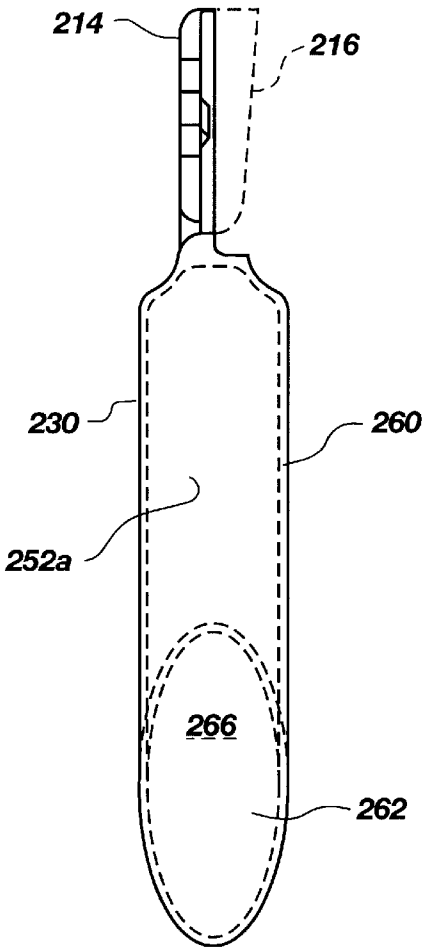
FIG. 3A shows an end view of the ice axe head shown in FIG. 3, the handle being omitted.
Figure 3:
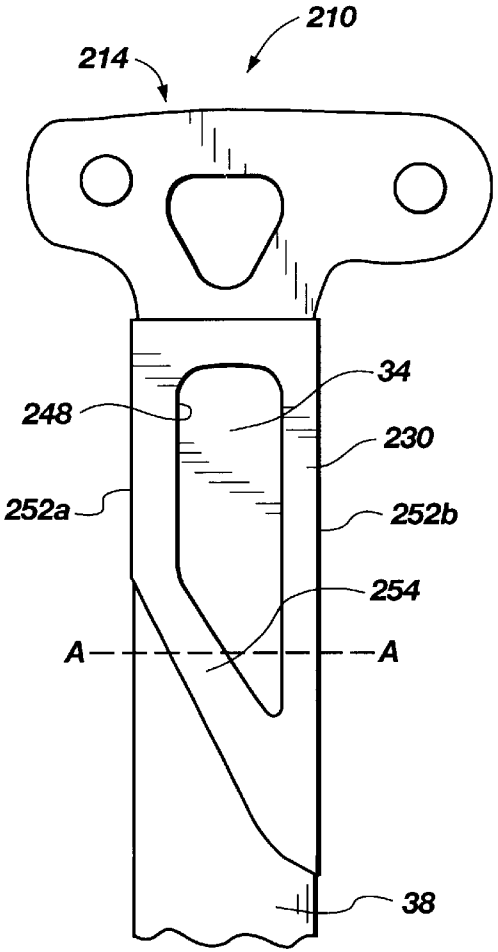
FIG. 3 shows a side view of yet another lugged ice axe head attached to a handle in accordance with the present invention.

Referring now to FIG. 3, there is shown a side view of another ice axe 210 made in accordance with the present invention. The head portion 214 of the ice axe 210 is attached to or formed integrally with the generally hollow lug sleeve 230. The sleeve 230 receives the upper end 34 of the handle 38, in a similar manner as the sleeves 30 and 130 discussed with respect to FIGS. 1 and 2, respectively.

The sleeve 230 is different than the prior embodiments discussed in that the forward side 252*a* is shorter than the rearward side 252*b*. The primary advantage of such an arrangement is that the weight of the sleeve 230 is kept to a minimum, while still providing significant protection to the forward side 252*a* and the rearward side 252*b*.

To keep weight to a minimum, the opening 248 along the lateral side of the lug sleeve 230 is relatively large. Thus, the primary protection of the sleeve 230 is focused on direct impact on the leading edges or curvatures (forward side 252*a* and rearward side 252*b*). Of course, the portion of the lug sleeve 230 positioned along the lateral sides 254 still provides some protection, especially from a broad impact, such as might occur against a relatively large rock.

Referring now to FIG. 3A, there is shown a frontal view of the head portion 214 and the sleeve 230 of FIG. 3. The head portion 214 is shown as a first base member which represents approximately half of a conventional ice axe head. A corresponding second base member which can be bolted to the first base member to form a complete head is represented by dashed line 216. The first and second base members form an integrated modular ice axe head such as that described and claimed in U.S. Pat. No. 5,768,727 (U.S. patent application Ser. No. 08/587,730, identified as attorney docket number T3514 and filed on Jan. 19, 1996) which is expressly incorporated herein. The two base members allow for accessories of different widths to be attached to the head portion 214 conveniently. Of course, numerous different kinds of ice axe heads could be attached to the sleeve.

The sleeve 230 has an annular side wall 260 which will vary in thickness depending of the material out of which the sleeve 230 is made. For example, if the sleeve 230 is made of steel, the side wall 260 will be between about 0.040 inches and 0.100 inches in thickness. The thickness is determined by the need to form a very durable sleeve which will withstand numerous impacts; the desire to eliminate any excess weight; and manufacturing abilities.

The sleeve 230 terminates in a lower opening 262 which is only slightly larger than the handle 38 (FIGS. 1–3) and which leads into the hollow central portion 266. The opposing end is closed and is attached to the head portion 214.

Figure 4:
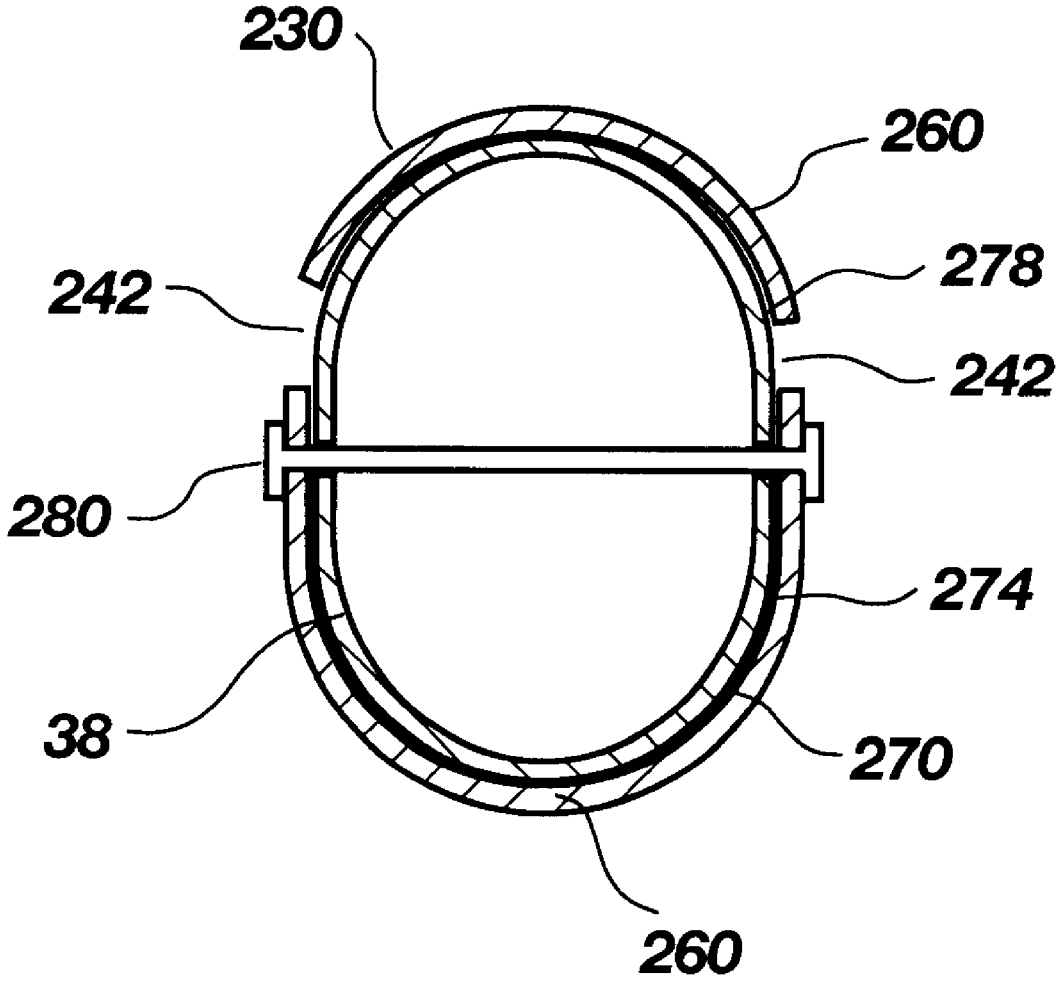
FIG. 4 shows a cross-sectional view of the handle and sleeve of the ice axe head taken along the line A—A in FIG. 3.

Referring now to FIG. 4, there is shown a cross-sectional view of the handle 38 and sleeve 30, 130, or 230, such as taken along the sleeve at line A—A of FIG. 3. The side wall 260 is disposed about the handle 38.

The inner surface 270 of the side wall 260 is positioned so that the sleeve 230 fits snugly about the handle 38. However, enough room may be left for a layer of adhesive 274 and for manufacturing tolerances. A weld 278 may also be used to bond the handle 38 to the sleeve 230. In addition or in the alternative, the handle may be held to the sleeve 230 by a rivet 280, or by a bolt as described with respect to FIG. 2. Which method or methods are preferable will depend on the substances which are used to form the handle 38 and the sleeve 230.

Also shown in FIG. 4 are the openings 242 in the otherwise annular sleeve. While a small opening 242 is shown in FIG. 3B, higher up on the sleeve 30, the openings are much larger.

Thus, there is disclosed a lugged ice axe which provides improved protection for the handle, and also accomplishes the objects of the present invention. Those skilled in the art will recognize numerous modifications which can be made without departing from the scope or spirit of the invention. The appended claims are intended to cover such modifications.

What is claimed is:

1. A lugged ice axe head for attachment to an upper portion of an ice axe handle comprising:

an ice axe head portion for attachment to ice axe accessories; and an elongate sleeve attached to and extending downwardly from the ice axe head portion, the sleeve having a hollow central portion and terminating in a lower opening for receiving the ice axe handle within the sleeve, the sleeve having an opposing end that is attached to the head portion, and having plural openings formed in a side thereof so as to expose portions of the handle.

2. The lugged ice axe head of claim 1, wherein the elongate sleeve has a plurality of openings formed therein so as to expose portions of the handle.

3. The lugged ice axe head of claim 2, wherein the elongate sleeve has forward, rearward and lateral sides, and wherein the openings are formed in the lateral sides.

4. The lugged ice axe head of claim 1, wherein the elongate sleeve is nested about the upper portion of the handle.

5. The lugged ice axe head of claim 4, wherein the elongate sleeve is attached to the handle by an adhesive.

6. The lugged ice axe head of claim 4, wherein the elongate sleeve is attached to the handle by at least one bolt.

7. The lugged ice axe head of claim 4, wherein the elongate sleeve is attached to the handle by a rivet.

8. The lugged ice axe head of claim 4, wherein the elongate sleeve is welded to the handle.

9. The lugged ice axe head of claim 1, wherein the elongate sleeve is welded to the head portion.

10. The lugged ice axe head of claim 1, wherein the elongate sleeve is formed integrally with the head portion.

11. The lugged ice axe head of claim 1, wherein the elongate sleeve is formed of metal.

12. The lugged ice axe head of claim 1, wherein the elongate sleeve has forward, rearward and lateral sides, and wherein the sleeve along one of said forward and rearward sides extends beyond the sleeve along the lateral sides.

13. An ice axe comprising:

a head portion formed for attachment to ice axe accessories;

an elongate sleeve attached to and extending downwardly from the ice axe head portion, the sleeve having a central hollow and terminating in a lower opening with an opposing end that is attached to the head portion, and having at least one opening formed in a side thereof; and an elongate handle nested within the elongate sleeve and attached thereto, such that the handle is fixedly attached to the head portion, and portions of the handle disposed within the sleeve are exposed through the plural openings formed in a side of the sleeve.

14. The ice axe of claim 13, wherein at least one of the accessories is fixedly attached to the head portion.

15. The ice axe of claim 13, wherein the handle is attached to the elongate sleeve by an adhesive.

16. The ice axe of claim 13, wherein the handle is attached to the elongate sleeve by welding.

17. The ice axe of claim 13, wherein the handle is attached to the elongate sleeve by a rivet.

18. The ice axe of claim 13, wherein the handle is attached to the elongate sleeve by at least one bolt.

19. The ice axe of claim 13, wherein the elongate sleeve has a plurality of openings formed therein so as to expose portions of the handle disposed within the sleeve.

20. The ice axe of claim 19, wherein the elongate sleeve has forward, rearward and lateral sides, and wherein the openings are formed in the lateral sides.

21. The ice axe of claim 13, wherein the elongate sleeve is formed integrally with at least part of the head portion.

22. A method for attaching an ice axe head portion to a handle, the method comprising:

(a) selecting an ice axe head portion, the ice axe head portion having an elongate sleeve attached thereon, the elongate sleeve having a central hollow formed therein and terminating in a lower opening with an opposing end that is closed for attaching to the head portion, and having at least one opening formed in a side thereof, the elongate sleeve extending downwardly from the head portion;

(b) positioning an end of the handle within the central hollow; and (c) attaching the handle to the elongate sleeve such that portions of the handle disposed within the sleeve are exposed through the plural openings formed therein.

23. The method of claim 22, wherein step (a) comprises, more specifically, selecting an ice axe head portion, selecting an elongate sleeve having a central hollow formed therein and terminating in a lower opening with an opposing end for attaching to the head portion, and attaching the elongate sleeve to the ice axe head so that the lower opening of the elongate sleeve extends downwardly.

* * * * *